US012129731B2

(12) United States Patent
Mukhlifi et al.

(10) Patent No.: US 12,129,731 B2
(45) Date of Patent: Oct. 29, 2024

(54) PROTECTING WELLHEAD EQUIPMENT FROM TREATMENT FLUIDS

(71) Applicant: Saudi Arabian Oil Company, Dhahran (SA)

(72) Inventors: Mohammed E. Mukhlifi, Dammam (SA); Mansour A. Amer, Dammam (SA); Mohammed K. Muqri, Dhahran (SA); Pandu Wirawan, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 148 days.

(21) Appl. No.: 17/730,727

(22) Filed: Apr. 27, 2022

(65) Prior Publication Data

US 2023/0349257 A1 Nov. 2, 2023

(51) Int. Cl.
*E21B 33/03* (2006.01)
*E21B 33/068* (2006.01)

(52) U.S. Cl.
CPC ..... *E21B 33/068* (2013.01); *E21B 33/03* (2013.01)

(58) Field of Classification Search
CPC ..... E21B 33/03
See application file for complete search history.

(56) References Cited

U.S. PATENT DOCUMENTS 6,039,120 A 3/2000 Wilkins et al.
6,873,267 B1 3/2005 Tubel et al.
8,157,006 B2 4/2012 Koleilat et al.
8,327,943 B2 12/2012 Borak et al.
8,485,262 B1 * 7/2013 Angers ..... E21B 33/035 166/85.1
2008/0230226 A1 * 9/2008 Lam ..... E21B 43/2607 166/308.1
2009/0090515 A1 * 4/2009 Chan ..... E21B 33/068 166/382
2011/0108275 A1 5/2011 Borak et al.
2014/0020901 A1 * 1/2014 Kajaria ..... E21B 33/068 166/308.1
2014/0020906 A1 * 1/2014 Travis ..... E21B 33/03 166/368
2019/0093443 A1 * 3/2019 Hogan ..... E21B 33/068
2021/0270104 A1 * 9/2021 Løvoll ..... E21B 33/043

FOREIGN PATENT DOCUMENTS

CA 2639869 4/2009
CA 2720023 5/2011

* cited by examiner

*Primary Examiner* — Giovanna Wright
(74) *Attorney, Agent, or Firm* — Fish & Richardson P.C.

(57) ABSTRACT

A wellhead assembly includes a production tree, a sacrificial fluid control assembly, an adaptor assembly, and a sleeve. The sacrificial fluid control assembly is fluidly coupled to the production tree. The adaptor assembly resides between the production tree and the sacrificial fluid control assembly. The adaptor assembly forms, with the adaptor assembly attached to the production tree and the sacrificial fluid control assembly, a common bore. The sleeve is disposed within the common bore and extends from the adaptor assembly to the tubing spool. The sleeve includes i) a first end that forms, with the adaptor or the sacrificial fluid control assembly, a first fluid seal, and ii) a second end opposite the first end and forming, with the tubing spool, a second fluid seal such that the sleeve fluidly isolates a first section of the common bore from a second section of the common bore.

20 Claims, 4 Drawing Sheets

PROTECTING WELLHEAD EQUIPMENT FROM TREATMENT FLUIDS

FIELD OF THE DISCLOSURE

This disclosure relates to wellbore equipment, and more particularly to wellhead equipment for cleaning and stimulating a production well.

BACKGROUND OF THE DISCLOSURE

A wellhead is an assembly of equipment at the surface of a production wellbore. The wellhead is in fluid communication with the wellbore to provide pressure control to the wellbore. The wellhead allows fluid to be injected into the wellbore to clean the well, stimulate the well, or otherwise treat the well to enhance the productivity or injectivity of the wellbore. For example, the wellhead can receive an acid that is pumped downhole and into a geologic formation to dissolve composites and minerals and thus increase the productivity and recovery of hydrocarbons. Methods and equipment for improving wellbore stimulation and cleaning operations are sought.

SUMMARY

Implementations of the present disclosure include a wellhead assembly that includes a production tree, a sacrificial fluid control assembly, an adaptor assembly, and a sleeve. The production tree resides at a terranean surface of a well. The production tree is coupled to a tubing spool. The sacrificial fluid control assembly is fluidly coupled to and resides above the production tree. The adaptor assembly is fluidly coupled to and resides between the production tree and the sacrificial fluid control assembly. The adaptor assembly forms, with the adaptor assembly attached to the production tree and the sacrificial fluid control assembly, a common bore. The common bore defines a fluid pathway extending from the tubing spool to the sacrificial fluid control assembly. The sleeve is disposed within the common bore and extends at least from the adaptor assembly to the tubing spool. The sleeve includes i) a first end configured to form, with the adaptor or the sacrificial fluid control assembly, a first fluid seal, and ii) a second end opposite the first end and configured to form, with the tubing spool, a second fluid seal such that the sleeve fluidly isolates a first section of the common bore from a second section of the common bore. The first section of the common bore extends from the first fluid seal to the second fluid seal.

In some implementations, the first section of the common bore includes at least a portion of a bore of the tubing spool, a bore of the production tree, and at least a portion of a bore of the adaptor assembly. The second section of the common bore includes at least a section of a bore of the sacrificial control assembly. In some implementations, the sleeve fluidly isolates the first section of the common bore from a treatment fluid during uphole or downhole flow of the treatment fluid along the fluid pathway. The treatment fluid includes at least one of acid, hydrogen sulfide, or carbon dioxide. In some implementations, the sacrificial fluid control assembly includes a sacrificial production tree and a sacrificial tree cap attached to an upper end of the sacrificial production tree. The sacrificial production tree is fluidly coupled to a pump configured to flow a treatment fluid from the terranean surface of the wellbore, through the wellhead assembly, to the wellbore, with the sacrificial production tree exposed to the treatment fluid. In some implementations, the tree cap includes at least one of a sacrificial gate valve or a back pressure valve lubricator. The tree cap opens to receive the sleeve and a running tool configured to dispose the sleeve within the common bore. In some implementations, the sleeve forms, with the running tool, a bayonet style pin-and-slot releasable connection to allow the running tool to dispose the sleeve within the common bore and disengage the sleeve after the sleeve is secured within the common bore.

In some implementations, the adaptor assembly includes internal slips movable from outside the adaptor assembly. The internal slips retain the sleeve within the common bore.

In some implementations, the tubing spool includes a tubing hanger that includes a back pressure valve profile. The second end of the sleeve is forms, with the back pressure valve profile of the tubing hanger, a connection with the tubing hanger. The sleeve or the tubing hanger includes one or more sealing rings that form the second fluid seal.

Implementations of the present disclosure also include a well assembly that includes a production tree, a tree cap, an adaptor, and a sleeve. The tree cap is coupled to the production tree. The adaptor is fluidly coupled to and resides between an upper end of the production tree and a lower end of the tree cap to form a wellhead bore defining a fluid pathway extending from the production tree to the adaptor. The sleeve is disposed within the wellhead bore and extends at least from the adaptor to the production tree. The sleeve has i) a first portion configured to form, with the adaptor or another portion of the well assembly, a first fluid seal, and ii) a second portion configured to form, with the production tree or another portion of the well assembly, a second fluid seal such that the sleeve fluidly isolates a first section of the wellhead bore from a second section of the wellhead bore. The first section of the wellhead bore extends from the first fluid seal to the second fluid seal and includes a bore of the production tree.

In some implementations, the well assembly further includes a sacrificial production tree fluidly coupled to and residing above the production tree and below the tree cap. The second section of the wellhead bore includes a bore of the sacrificial production tree. The sacrificial production tree is fluidly coupled to a pump that flows a treatment fluid along the fluid pathway with the second section of the wellhead bore exposed to the treatment fluid and the first section of the wellhead bore isolated from the treatment fluid.

In some implementations, the well assembly further includes a tubing spool disposed between the production tree and a wellbore. The second portion of the sleeve forms a fluid seal with a tubing hanger of the tubing spool. In some implementations, the tubing hanger forms, with the sleeve, a threaded or groove-and-pin connection and the sleeve or the tubing hanger has one or more sealing rings to form the second fluid seal.

In some implementations, the tree cap opens to receive the sleeve and a running tool configured to releasably engage and position the sleeve within the wellhead bore. The running tool disengages the sleeve after the sleeve is secured in place by slips of the adaptor.

In some implementations, the adaptor slips are movable from outside the adaptor assembly. The adaptor assembly engages an engagement feature of the sleeve to secure the sleeve within the common bore.

Implementations of the present disclosure also include a method that includes disposing a sleeve within a bore of a wellhead. The wellhead includes i) a production tree, ii) a removable sacrificial production tree configured to be fluidly coupled to and reside above the production tree, and iii) a removable adaptor configured to be fluidly coupled to and reside between the production tree and the sacrificial production tree. At least a bore of the production tree, a bore of the sacrificial production tree, and a bore of the adaptor together form the bore of the wellhead. The bore of the wellhead defines a fluid pathway that extends from the production tree to the sacrificial production tree. The method also includes securing the sleeve to the adaptor such that the sleeve forms, with the adaptor or another portion of the well assembly, a first fluid seal, and the sleeve forms, with the production tree or another portion of the well assembly, a second fluid seal such that the sleeve fluidly isolates a first section of the bore from a second section of the bore. The first section of the bore extends from the first fluid seal to the second fluid seal and includes a bore of the production tree. The method also includes flowing, from the sacrificial production tree, through the sleeve, and to a wellbore fluidly coupled to the wellhead, a treatment fluid. The first section of the bore is isolated from the treatment fluid by the sleeve.

In some implementations, the method further includes, before disposing the sleeve within the bore of the wellhead, attaching the adaptor to an upper outlet end of the production tree, attaching the sacrificial production tree to an upper end of the adapter, and attaching a sacrificial gate valve to an upper end of the sacrificial production tree. The gate valve is configured to open and receive, from outside and above of the wellhead, the sleeve.

In some implementations, the method further includes, after attaching the sacrificial gate valve, opening the sacrificial gate valve and lowering, with a running tool releasably engaged with the sleeve, the sleeve from an outlet of the sacrificial gate valve to the adaptor to allow the adaptor to secure an upper end of the sleeve.

In some implementations, securing the sleeve includes externally moving slips of the adaptor inwardly to engage and secure the sleeve.

In some implementations, flowing the treatment fluid includes flowing, with a pump fluidly coupled to the sacrificial production tree, the treatment fluid from the production tree to the wellbore to perform a wellbore treatment operation to restore or enhance productivity of the wellbore.

In some implementations, the method further includes, after performing the wellbore treatment operation, removing the sleeve from the wellbore and removing the adaptor and the sacrificial production tree from the production tree.

DETAILED DESCRIPTION OF THE DISCLOSURE

The present disclosure relates to methods and equipment for performing well stimulation and cleaning operations. Well stimulation and cleaning operations can include acidizing the well and performing hydraulic fracturing. Acidizing involves flowing acid or other corrosive fluids from the surface of a wellbore to a downhole formation, which can corrode or otherwise damage the steel tubulars and equipment of the well. Acidizing can be used to clean the wellbore equipment and tubulars or to stimulate the wellbore or both. During treatment or cleaning operations, the treatment fluids can corrode or otherwise damage the wellhead equipment. To protect the wellhead equipment from the treatment fluids (e.g., acid), a sleeve and sacrificial equipment can be used to isolate the wellhead equipment from the acid. For example, a sleeve or isolation tube can fluidly isolate the existing or permanent production tree of the welled and a sacrificial production tree can receive the acid, preventing the existing production tree from being exposed to the acid.

Particular implementations of the subject matter described in this specification can be implemented so as to realize one or more of the following advantages. For example, protecting the existing production tree from acid during acidizing operations can reduce or eliminate the need to maintain or replace the production tree and other wellbore equipment, which can save time and resources. Furthermore, using a removable sacrificial production tree allows acidizing of the wellbore without removing the existing production tree and while protecting the existing production tree. Additionally, the sacrificial production tree can be less costly than the existing production tree, which can save resources even if the sacrificial production tree has to be replaced relatively often.

Figure 1:
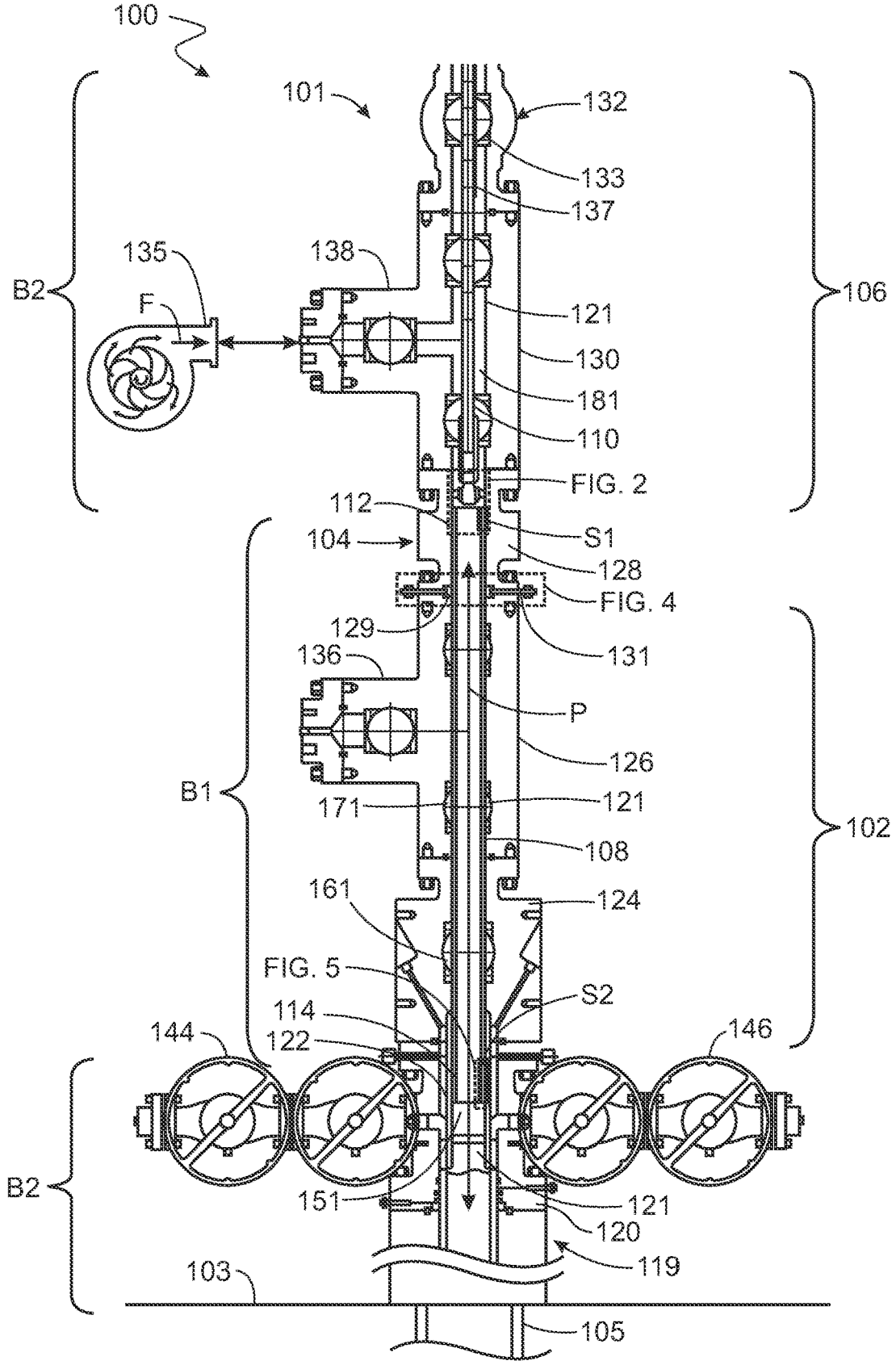
FIG. 1 is a schematic front view, partially cross-sectional, of a wellhead assembly.

FIG. 1 shows a well assembly 100 that includes a wellbore 105 and a wellhead or wellhead assembly 101 fluidly coupled to the wellbore 105. The wellbore 105 can be a horizontal or non-vertical wellbore that extends from a terranean surface 103 of the wellbore to a geologic formation. The geologic formation can include a hydrocarbon reservoir from which hydrocarbons can be extracted.

The wellhead assembly 101 includes existing equipment (e.g., permanent or semi-permanent) and removable equipment (e.g., temporal or non-permanent). For example, the existing equipment can be the equipment originally installed on the well or the equipment intended to remain long-term as part of the well. The existing equipment includes a wellhead base assembly 119, a tubing spool 120, and a "Christmas tree" or production tree assembly 102. The non-permanent equipment includes an adaptor or adaptor assembly 104, a sacrificial fluid control assembly 106, and a protective sleeve 108. The sacrificial fluid control assembly 106 can be fluidly coupled to a surface pump 135 that flows fluid (e.g., treatment fluid) into the wellbore 105.

The wellhead base assembly 119 resides at or near the terranean surface 103 of the wellbore 105, and is the lowermost part of the wellhead 101. The wellhead base assembly 119 can include at least one of a casing head, a conductor casing, and casing hangers. The tubing spool 120 is attached to (e.g., with screws or bolts) and disposed above the wellhead base assembly 119. The production tree assembly 102 is attached to (e.g., with screws or bolts) and disposed above the tubing spool 120. The production tree assembly 102 includes a production tree 126 and a lower manual master valve 124. In some implementations, the lower manual master valve 124 can be part of the production tree 126. The production tree 126 includes a fluid inlet/outlet 136 with a valve (e.g., a swab valve or wing valve) that regulates the fluid flowing to and from the production tree 126.

The tubing spool 120 can include or be coupled to multiple valves 144 and 146 (e.g., wing valves). The tubing spool 120 has a tubing hanger 122 disposed at the bore of the tubing spool 120. The tubing hanger 122 can retain a casing pipe or other equipment of the wellbore 105.

The adaptor assembly 104 is attached to (e.g., with screws or bolts) and disposed above the production tree assembly 102. The sacrificial fluid control assembly 106 is attached to (e.g., with screws or bolts) and disposed above the adaptor assembly 104. The protective or isolation sleeve 108 is inserted into the wellhead through an upper end of the sacrificial control assembly 106. The isolation sleeve 108 isolates some of the wellhead equipment from acid or other fluids during well stimulation operations. The wellbore 105 is fluidly coupled is fluidly coupled to the sacrificial control assembly 106 such that, with the respective valves of the wellhead opened, fluid flows between the wellbore 105 and the sacrificial control assembly 106.

The adaptor assembly 104 resides between the production tree assembly 102 and the sacrificial fluid control assembly 106. The adaptor assembly 104 forms, with the adaptor assembly 104 attached to the production tree assembly 102 and the sacrificial fluid control assembly 106, a common bore or wellhead bore 121 defining a fluid pathway "P" that extends at least from the tubing spool 120 to the sacrificial fluid control assembly 106. The common bore 121 can be formed by multiple aligned bores of the wellhead equipment.

The sacrificial fluid control assembly 106 includes a sacrificial production tree 130 and a tree cap 132 attached to an upper end of the sacrificial production tree 130. The sacrificial production tree 130 includes a fluid inlet 138 fluidly coupled to the pump 135. The fluid inlet 138 has a valve (e.g., a swab valve or wing valve) that regulates the fluid to and from the pump 135. The pump 135 flows a treatment fluid "F" (e.g., acid or other abrasive or corrosive fluid) to treat the wellbore 105. For example, the pump 135 flows the treatment fluid "F" from the terranean surface 103 of the wellbore 105, through the wellhead assembly 101, to the wellbore 105. The treatment fluid "F" can increase the productivity of the wellbore 105 or clean the wellbore 105 or both. During the wellbore treatment operation, the sacrificial production tree 130 is exposed to the treatment fluid "F" and the parts of the wellhead protected by the sleeve 108 are not.

The tree cap 132 can include a sacrificial gate valve 133 or some other type of valve. The tree cap 132 can also include a back pressure valve lubricator 137. The gate valve 133 opens to receive the sleeve 108 and a running tool 110 that disposes the sleeve within the wellhead. The back pressure valve lubricator 137 can be used to retain the running tool 110 during installation of the sleeve 108.

The sleeve 108 is a removable tube that, when disposed within the common bore 121 (and is secured in place), extends from the adaptor assembly 104 to the tubing spool 120. In some implementations, the sleeve 108 can extend from the wellhead base assembly 119 to the sacrificial fluid control assembly 106.

The adaptor assembly 104 includes a housing 128, slips 129, and lock down screws 131 attached to the slips 129. The lock down screws 131 extend from an external surface of the adaptor housing 128 to the internal slips 129. The lock downs screws 131 can be rotated from outside the wellhead to move the slips 129 inwardly or outwardly to secure or release the sleeve 108 to the adaptor 104. Thus, the sleeve 108 is held in place by the internal slips 129 that clamp the sleeve 108 and prevent the sleeve 108 from moving along the common bore 121.

The sleeve 108 has a first end 112 and a second end 114 opposite the first end 112. As further described in detail below with respect to FIG. 2, the first 112 forms, with an internal surface or bore of the adaptor assembly 104, a first fluid seal "S1." In some implementations, the sleeve 108 forms the first fluid seal with another part of the wellhead, such as with the sacrificial fluid control assembly 106. As further described in detail below with respect to FIG. 5, the second end 114 forms, with the tubing spool 120, a second fluid seal "S2." The first seal "S1" and the second seal "S2" are arranged such that the sleeve 108 fluidly isolates a first section "B1" of the common bore 121 from a second section or sections "B2" of the common bore 121.

The first section or isolated section "B1" of the common bore 121 extends from the first fluid seal "S1" to the second fluid seal "S2." The first section first section "B1" can include a narrow gap defined between an outer surface of the sleeve 108 and a section of the common bore 121. The first section "B1" of the common bore 121 includes at least a portion of a bore 151 of the tubing spool 120, a bore 161 of the manual master valve 124, a bore 171 of the production tree 126, and at least a portion of a bore of the adaptor assembly 104. The second section "B2" of the common bore 121 includes at least a section of a bore 181 of the sacrificial control assembly 106.

To perform a stimulation or cleaning operation, the wellhead 101 can first be fluidly isolated from the wellbore 105 by closing a valve of the tubing spool 120 or the wellhead base assembly 119. Then, after removing a cap or any component attached to the upper end of the existing production tree 126, the adaptor assembly 104 along with the sacrificial fluid control assembly 106 can be attached to the upper end of the existing production tree 126. The adaptor assembly 104 can be installed in parts, by first attaching the sacrificial production tree 130 and then attaching the tree cap 132 to the sacrificial production tree 130. Then, to install the protective sleeve 108, the gate valve 133 can be opened to allow the running tool 110 to lower the sleeve 108 within the bore of the wellhead 101. Once the sleeve 108 is at the desired position, the slips 129 engage the sleeve 108 to secure the sleeve 108 in place. With the sleeve 108 in place, the running tool 110 is pulled out of the wellhead and, after closing the gate valve 133 and establishing fluid communication between the wellhead 101 and the wellbore 105, the pump 135 flows treatment fluid "F" into the wellbore 105.

To remove the sleeve 108, the wellhead is again fluidly isolated from the wellbore 105 and, after opening the gate valve 133, the running tool 110 is lowered to engage and retrieve the sleeve 108 (by pulling the sleeve out of the hole). With the sleeve 108 removed, the adaptor assembly 104 and the sacrificial fluid control assembly 106 can be removed from the production tree 126.

Figure 2:
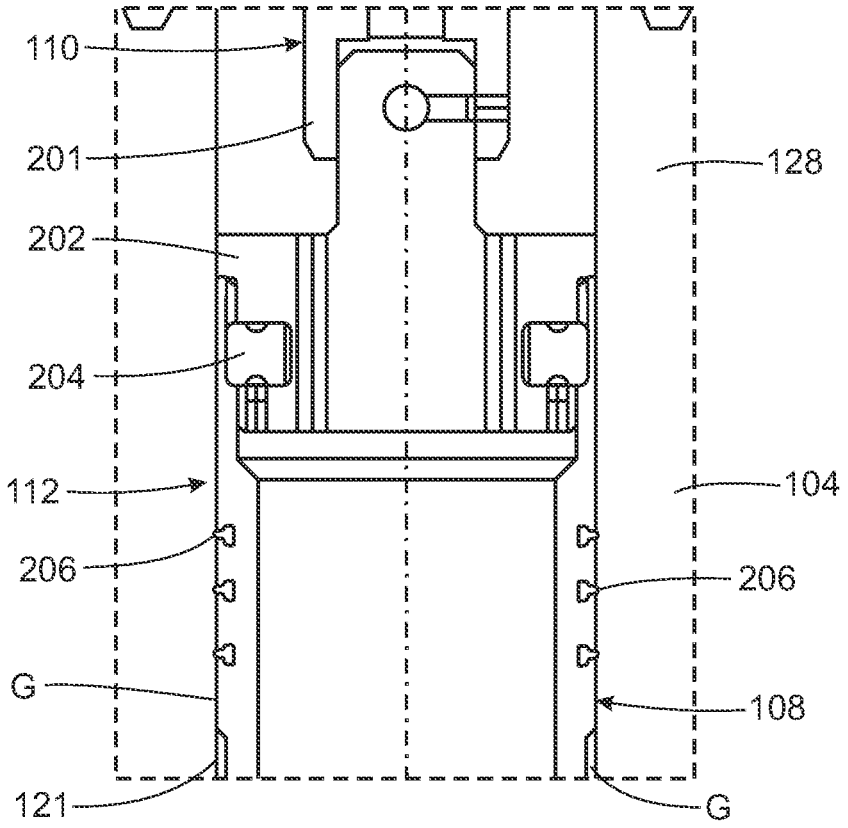
FIG. 2 is a detail view of a first end of a protective sleeve of the wellhead assembly in FIG. 1.
Figure 3:
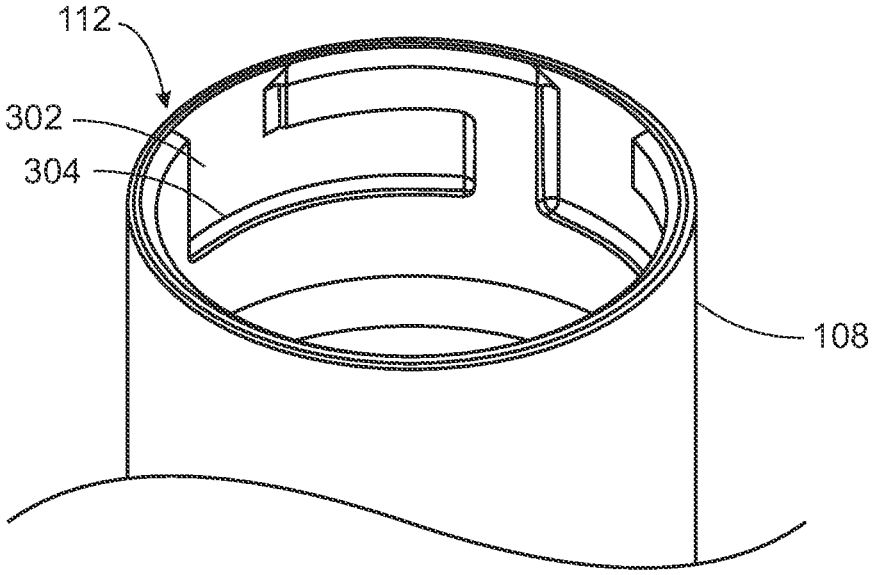
FIG. 3 is a schematic, perspective view of a portion of the protective sleeve.

FIG. 2 shows a detail view of the first end or top end 112 of the sleeve 108 engaged by the running tool 110 and disposed within the adaptor assembly 104. Referring also to FIG. 3, the top end 112 of the sleeve 108 has engagement features 302 or an engagement profile such as L-shaped or J-shaped inner slots 304 that engage the outwardly projecting pins 204 of the running tool 110. For example, the slots 304 form, with the pins 204 of the running tool 110, a bayonet style pin-and-slot releasable connection to allow the running tool 110 to reliably and quickly engage and disengage the sleeve 108. The running tool 110 engages the sleeve 108 to dispose the sleeve 108 within the common bore. The running tool 110 disengages the sleeve by simply rotating the running tool 110 with respect to the sleeve 108. For example, once the sleeve 108 is secured within the common bore, the running tool 110 is rotated and pulled up to disengage the sleeve 108.

The running tool 110 can include an end of tool portion 202 that has the pins 204 to engage the sleeve 108. The end of tool portion 202 can be pivotally connected to an arm 201 of the tool 110 to allow the end of tool portion 202 to move and accommodate different angles of the arm 201.

Additionally, the sleeve 108 can have multiple sealing rings 206 (e.g., O-rings) that form the first fluid seal with the inner surface of the housing 128 of the adaptor 104. Alternatively or additionally, the adaptor 104 can have sealing rings to form the sealing connection with the sleeve 108. The sealing rings prevent fluid from flowing into the annular gap "G" from the upper end of the sleeve 108. The gap "G" can be defined between an external surface of the sleeve 108 and a section of the common bore 121.

Figure 4:
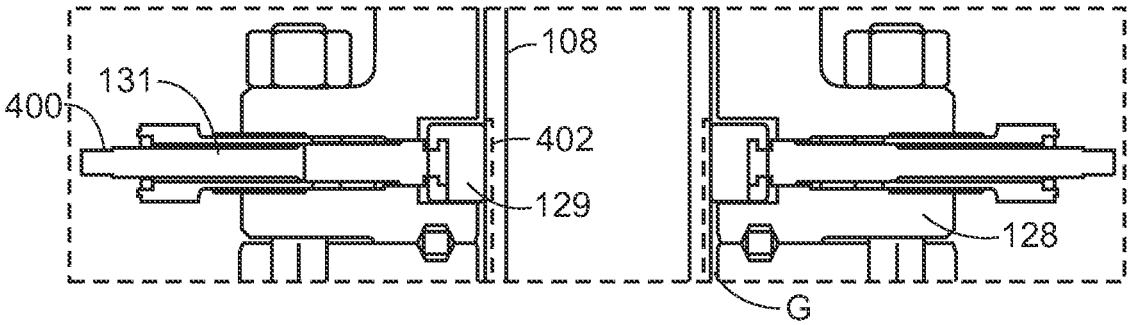
FIG. 4 is a detail view of a portion of an adaptor assembly of the wellhead assembly in FIG. 1.

Referring now to FIG. 4, the lock down screws 131 are threadedly attached to the housing 128 of the adaptor. The screws 131 also extend through the housing 128 to move the slips 129 with respect to the sleeve 108. Thus, the internal slips 129 are movable from outside the adaptor assembly to the sleeve 108 within the common bore. The slips 129 can be disposed between the two fluid seals, in the fluidly isolated region (e.g., the isolated gap "G") of the common bore. In some implementations, the sleeve 108 can have an outer groove 402 (or another type engagement feature such as teeth or a rough surface) to accommodate or engage the slips 129 in place and ensure that sufficient retaining force is achieved during well stimulation activities.

Figure 5:
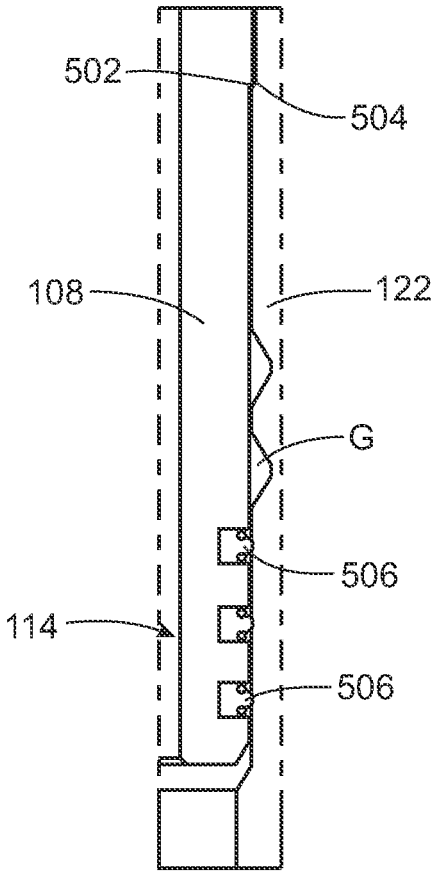
FIG. 5 is a detail view of a second end of the protective sleeve of the wellhead assembly in FIG. 1.

FIG. 5 depicts the second end or lower end 114 of the sleeve 108 disposed inside the tubing hanger 122 of the tubing spool. The lower end 114 of the sleeve 108 has sealing rings 506 (e.g., O-rings) that form the second fluid seal with the inner surface or bore of the tubing hanger 122. The second seal prevents fluid from flowing into the gap "G" from the lower end of the sleeve 108. Thus, the two fluid seals together bound the first section of the bore to isolate the first section of the bore. Alternatively or additionally, the tubing hanger 122 can have sealing rings to form the second seal with the sleeve 108. In some implementations, the first and second seals can be formed with a different inner surface of another component of the wellhead.

The lower end 114 of the sleeve 108 can have an engagement profile similar to an engagement profile of other equipment (e.g., a back pressure valve) configured to interface with the tubing hanger 122. For example, the tubing hanger 122 can have a back pressure valve profile, and the second end of the sleeve 108 can have a corresponding profile to form, with the back pressure valve profile of the tubing hanger 122, a connection with the tubing hanger 122. The second end 114 can form, with the tubing hanger 122, a threaded or groove-and-pin connection, or any connection that the tubing hanger 122 would form with the back pressure valve or other equipment. In some implementations, the tubing hanger 122 can have an inwardly projecting shoulder 504 that engages or stops an outwardly projecting shoulder 502 of the sleeve 108. During installation of the sleeve 108, the inner shoulder 504 can stop the sleeve 108 from further moving downward, which can indicate that the sleeve 108 is in place and ready to be engaged by the slips.

Figure 6:
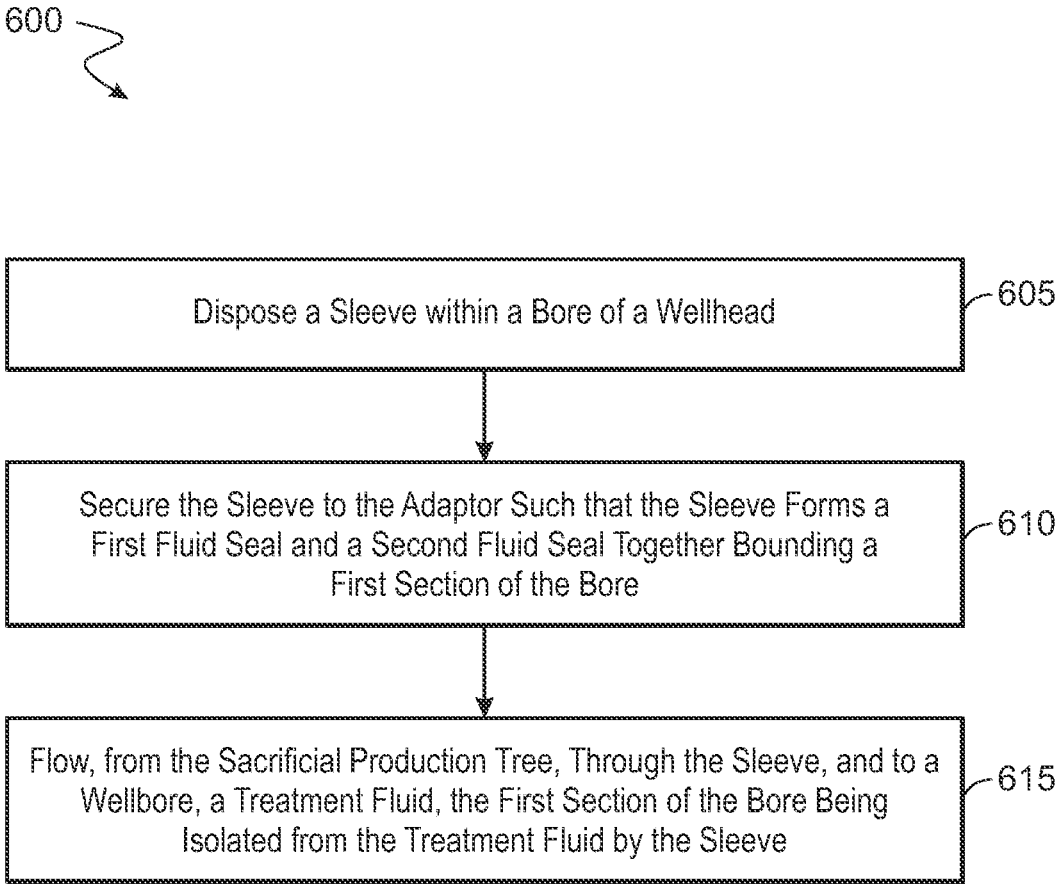
FIG. 6 is a flow chart of a method of treating a wellbore.

FIG. 6 shows a flow chart of a method 600 of protecting wellhead equipment from treatment fluids during a cleaning or stimulation operation. The method includes disposing a sleeve within a bore of a wellhead (608). The wellhead includes i) a production tree, ii) a removable sacrificial production tree configured to be fluidly coupled to and reside above the production tree, and iii) a removable adaptor configured to be fluidly coupled to and reside between the production tree and the sacrificial production tree. At least a bore of the production tree, a bore of the sacrificial production tree, and a bore of the adaptor together form the bore of the wellhead, and the bore of the wellhead defines a fluid pathway extending from the production tree to the sacrificial production tree. The method also includes securing the sleeve to the adaptor such that the sleeve forms, with the adaptor or another portion of the well assembly, a first fluid seal and a second fluid seal together bounding a first section of the bore (610). The second fluid seal is formed with the sleeve and the production tree or another portion of the well assembly such that the sleeve fluidly isolates a first section of the bore from a second section of the bore, the first section of the bore extending from the first fluid seal to the second fluid seal and including a bore of the production tree. The method also includes flowing, from the sacrificial production tree and to a wellbore, a treatment fluid. The first section of the bore is fluidly isolated from the treatment fluid by the sleeve (615).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the present disclosure.

What is claimed is:

1. A wellhead assembly, comprising:

a production tree residing at a terranean surface of a well and coupled to a tubing spool;

a sacrificial fluid control assembly configured to be fluidly coupled to and reside above the production tree the sacrificial fluid control assembly comprising a sacrificial production tree and a tree cap attached to an upper end of the sacrificial production tree, the sacrificial production tree fluidly coupled to a pump configured to flow a treatment fluid from the terranean surface of the well, through the wellhead assembly, and into the well, with the sacrificial production tree exposed to the treatment fluid;

an adaptor assembly configured to be fluidly coupled to and reside between the production tree and the sacrificial fluid control assembly, the adaptor assembly configured to form, with the adaptor assembly attached to the production tree and the sacrificial fluid control assembly, a common bore defining a fluid pathway extending from the tubing spool to the sacrificial fluid control assembly;

a sleeve configured to be disposed within the common bore and extend at least from the adaptor assembly to the tubing spool, the sleeve comprising i) a first end configured to form, with the adaptor or the sacrificial fluid control assembly, a first fluid seal, and ii) a second end opposite the first end and configured to form, with the tubing spool, a second fluid seal such that the sleeve fluidly isolates a first section of the common bore from a second section of the common bore, the first section of the common bore extending from the first fluid seal to the second fluid seal; and a running tool configured to dispose the sleeve within the common bore, the tree cap comprises at least one of a sacrificial gate valve or a back pressure valve lubricator, the tree cap configured to open to receive the sleeve and the running tool, the running tool comprising an end of tool portion configured to engage the sleeve, the end of tool portion pivotally connected to an arm of the running tool to allow the end of tool portion to pivot and accommodate different angles of the arm;

wherein the first section of the common bore comprises at least a portion of a bore of the tubing spool, a bore of all the production tree, and at least a portion of a bore of the adaptor assembly, and the second section of the common bore comprises at least a section of a bore of the sacrificial control assembly.

2. The wellhead assembly of claim 1, wherein the sleeve is configured to fluidly isolate the first section of the common bore from a treatment fluid during uphole or downhole flow of the treatment fluid along the fluid pathway, the treatment fluid comprising at least one of acid, hydrogen sulfide, or carbon dioxide.

3. The wellhead assembly of claim 1, wherein the sleeve forms, with the running tool, a bayonet style pin-and-slot releasable connection to allow the running tool to dispose the sleeve within the common bore and disengage the sleeve after the sleeve is secured within the common bore.

4. The wellhead assembly of claim 1, wherein the adaptor assembly comprises internal slips movable from outside the adaptor assembly, the internal slips configured to retain the sleeve within the common bore, and the sleeve comprises an external engagement feature configured to interface with the slips to allow the internal slips to secure the sleeve in place.

5. A wellhead assembly, comprising:

a production tree residing at a terranean surface of a well and coupled to a tubing spool;

a sacrificial fluid control assembly configured to be fluidly coupled to and reside above the production tree;

an adaptor assembly configured to be fluidly coupled to and reside between the production tree and the sacrificial fluid control assembly, the adaptor assembly configured to form, with the adaptor assembly attached to the production tree and the sacrificial fluid control assembly, a common bore defining a fluid pathway extending from the tubing spool to the sacrificial fluid control assembly; and a sleeve configured to be disposed within the common bore and extend at least from the adaptor assembly to the tubing spool, the sleeve comprising i) a first end configured to form, with the adaptor or the sacrificial fluid control assembly, a first fluid seal, and ii) a second end opposite the first end and configured to form, with the tubing spool, a second fluid seal such that the sleeve fluidly isolates a first section of the common bore from a second section of the common bore, the first section of the common bore extending from the first fluid seal to the second fluid seal;

wherein the first section of the common bore comprises at least a portion of a bore of the tubing spool, a bore of all the production tree, and at least a portion of a bore of the adaptor assembly, and the second section of the common bore comprises at least a section of a bore of the sacrificial control assembly, the tubing spool comprising a tubing hanger comprising a back pressure valve profile, and the second end of the sleeve is configured to form, with the back pressure valve profile of the tubing hanger, a connection with the tubing hanger, the sleeve or the tubing hanger comprising one or more sealing rings to form the second fluid seal, the tubing hanger comprising an inwardly projecting shoulder that engages or stops an outwardly projecting shoulder of the sleeve.

6. A well assembly, comprising:

a production tree;

a tree cap configured to be coupled to the production tree;

an adaptor configured to be fluidly coupled to and reside between an upper end of the production tree and a lower end of the tree cap to form a wellhead bore defining a fluid pathway extending from the production tree to the adaptor; and a sleeve configured to be disposed within the wellhead bore and extend at least from the adaptor to the production tree, the sleeve comprising i) a first portion configured to form, with the adaptor or another portion of the well assembly, a first fluid seal, and ii) a second portion configured to form, with the production tree or another portion of the well assembly, a second fluid seal such that the sleeve fluidly isolates a first section of the wellhead bore from a second section of the wellhead bore, the first section of the wellhead bore extending from the first fluid seal to the second fluid seal and comprising a bore of the production tree;

wherein the first section of the wellhead bore comprises at least a portion of a bore of a tubing spool attached to the production tree, a bore of all the production tree, and at least a portion of a bore of the adaptor assembly, and the second section of the wellhead bore comprises at least a section of a bore of the sacrificial control assembly, the tubing spool comprising a tubing hanger comprising a back pressure valve profile, and the second portion of the sleeve is configured to form, with the back pressure valve profile of the tubing hanger, a connection with the tubing hanger, the sleeve or the tubing hanger comprising one or more sealing rings to form the second fluid seal, the tubing hanger comprising an inwardly projecting shoulder that engages or stops an outwardly projecting shoulder of the sleeve.

7. The well assembly of claim 6, further comprising a sacrificial production tree configured to be fluidly coupled to and reside above the production tree and below the tree cap, the second section of the wellhead bore comprising a bore of the sacrificial production tree, the sacrificial production tree fluidly coupled to a pump configured to flow a treatment fluid along the fluid pathway with the second section of the wellhead bore exposed to the treatment fluid and the first section of the wellhead bore isolated from the treatment fluid.

8. The well assembly of claim 6, further comprising a tubing spool disposed between the production tree and a wellbore, the second portion of the sleeve configured to form a fluid seal with a tubing hanger of the tubing spool.

9. The well assembly of claim 8, wherein the tubing hanger is configured to form, with the sleeve, a threaded or groove-and-pin connection and the sleeve or the tubing hanger comprises one or more sealing rings to form the second fluid seal.

10. The well assembly of claim 6, further comprising a running tool configured to dispose the sleeve within the wellhead bore, the tree cap configured to open to receive the sleeve and the running tool configured to disengage the sleeve after the sleeve is secured in place by slips of the adaptor.

11. The well assembly of claim 6, wherein the slips are movable from outside the adaptor, the adaptor slips configured to engage an engagement feature of the sleeve to secure the sleeve within the wellhead bore.

12. A method, comprising:

disposing a sleeve within a bore of a wellhead, the wellhead comprising i) a production tree, ii) a removable sacrificial production tree configured to be fluidly coupled to and reside above the production tree, and iii) a removable adaptor configured to be fluidly coupled to and reside between the production tree and the sacrificial production tree, at least a bore of the production tree, a bore of the sacrificial production tree, and a bore of the adaptor forming the bore of the wellhead, the bore of the wellhead defining a fluid pathway extending from the production tree to the sacrificial production tree; and securing the sleeve to the adaptor such that the sleeve forms, with the adaptor or another portion of the wellhead, a first fluid seal, and the sleeve forms, with the production tree or another portion of the wellhead, a second fluid seal such that the sleeve fluidly isolates a first section of the bore from a second section of the bore, the first section of the bore extending from the first fluid seal to the second fluid seal and comprising a bore of the production tree; and flowing, from the sacrificial production tree, through the sleeve, and to a wellbore fluidly coupled to the wellhead, a treatment fluid, the first section of the bore being isolated from the treatment fluid by the sleeve, wherein the first section comprises at least a portion of a bore of a tubing spool attached to the production tree, a bore of all the production tree, and at least a portion of a bore of the adaptor assembly, and the second section comprises at least a section of a bore of the sacrificial control assembly, the tubing spool comprising a tubing hanger comprising a back pressure valve profile, and the second portion of the sleeve is configured to form, with the back pressure valve profile of the tubing hanger, a connection with the tubing hanger, the sleeve or the tubing hanger comprising one or more sealing rings to form the second fluid seal, the tubing hanger comprising an inwardly projecting shoulder that engages or stops an outwardly projecting shoulder of the sleeve, and the disposing comprises lowering the sleeve within the bore until the inwardly projecting shoulder stops at the outwardly projecting shoulder.

13. The method of claim 12, further comprising, before disposing the sleeve within the bore of the wellhead, attaching the adaptor to an upper outlet end of the production tree, attaching the sacrificial production tree to an upper end of the adapter, and attaching a sacrificial gate valve to an upper end of the sacrificial production tree, the gate valve configured to open and receive, from outside of the wellhead, the sleeve.

14. The method of claim 13, further comprising, after attaching the sacrificial gate valve, opening the sacrificial gate valve and lowering, with a running tool releasably engaged with the sleeve, the sleeve from an outlet of the sacrificial gate valve to the adaptor to allow the adaptor to secure an upper end of the sleeve.

15. The method of claim 14, wherein securing the sleeve comprises externally moving slips of the adaptor inwardly to engage and secure the sleeve.

16. The method of claim 12, wherein flowing the treatment fluid comprises flowing, with a pump fluidly coupled to the sacrificial production tree, the treatment fluid from the production tree to the wellbore to perform a wellbore treatment operation to restore or enhance a productivity of the wellbore.

17. The method of claim 16, the method further comprising, after performing the wellbore treatment operation, removing the sleeve from the wellbore and removing the adaptor and the sacrificial production tree from the production tree.

18. The method of claim 12, wherein the sleeve forms, with a running tool, a bayonet style pin-and-slot releasable connection, the disposing comprising disposing, with the running tool, the sleeve.

19. A method, comprising:

disposing a sleeve within a bore of a wellhead, the wellhead comprising i) a production tree, ii) a removable sacrificial production tree configured to be fluidly coupled to and reside above the production tree, and iii) a removable adaptor configured to be fluidly coupled to and reside between the production tree and the sacrificial production tree, at least a bore of the production tree, a bore of the sacrificial production tree, and a bore of the adaptor forming the bore of the wellhead, the bore of the wellhead defining a fluid pathway extending from the production tree to the sacrificial production tree; and securing the sleeve to the adaptor such that the sleeve forms, with the adaptor or another portion of the wellhead, a first fluid seal, and the sleeve forms, with the production tree or another portion of the wellhead, a second fluid seal such that the sleeve fluidly isolates a first section of the bore from a second section of the bore, the first section of the bore extending from the first fluid seal to the second fluid seal and comprising a bore of the production tree; and flowing, from the sacrificial production tree, through the sleeve, and to a wellbore fluidly coupled to the wellhead, a treatment fluid, the first section of the bore being isolated from the treatment fluid by the sleeve, wherein the first section comprises at least a portion of a bore of the tubing spool, a bore of all the production tree, and at least a portion of a bore of the adaptor assembly, and the second section comprises at least a section of a bore of the sacrificial control assembly, the tubing spool comprising a tubing hanger comprising a back pressure valve profile, and the second end of the sleeve is configured to form, with the back pressure valve profile of the tubing hanger, a connection with the tubing hanger, the sleeve or the tubing hanger comprising one or more sealing rings to form the second fluid seal, the tubing hanger comprising an inwardly projecting shoulder that engages or stops an outwardly projecting shoulder of the sleeve, and securing the sleeve to the adaptor comprises lowering the sleeve until the outwardly projecting shoulder bears against the inwardly projecting shoulder.

20. The method of claim 18, further comprising disengaging, with the running tool, the sleeve after the sleeve is secured within the bore.

* * * * *